US007387302B2

(12) United States Patent
Goldsmith et al.

(10) Patent No.: US 7,387,302 B2
(45) Date of Patent: Jun. 17, 2008

(54) ICE SKATE

(75) Inventors: Edward M. Goldsmith, Granada Hills, CA (US); Richard D. Grossman, Granada Hills, CA (US)

(73) Assignee: Easton Sports, Inc., Van Nuys, CA (US)

( * ) Notice: Subject to any disclaimer, the term of this patent is extended or adjusted under 35 U.S.C. 154(b) by 0 days.

(21) Appl. No.: 11/356,736

(22) Filed: Feb. 17, 2006

(65) Prior Publication Data

US 2007/0013152 A1 Jan. 18, 2007

Related U.S. Application Data

(63) Continuation of application No. 10/746,955, filed on Dec. 23, 2003, now abandoned, which is a continuation of application No. 10/230,799, filed on Aug. 28, 2002, now Pat. No. 6,695,322, which is a continuation of application No. 09/156,847, filed on Sep. 16, 1998, now Pat. No. 6,467,778.

(51) Int. Cl.
*A63C 1/32* (2006.01)

(52) U.S. Cl. ..... 280/11.12; 280/11.18

(58) Field of Classification Search ..... 280/11.12, 280/11.14, 11.15, 11.16, 11.17, 11.18, 28, 280/28.14, 811, 7.13
See application file for complete search history.

(56) References Cited

U.S. PATENT DOCUMENTS

| | | | |
|---|---|---|---|
| 90,282 | A | 5/1869 | McGrath |
| 326,119 | A | 9/1885 | Hyatt |
| 475,650 | A | 5/1892 | Wierda |
| 1,371,609 | A | 3/1921 | Drevitson |
| 1,666,690 | A | 4/1928 | Drevitson |
| 2,095,942 | A | 10/1937 | Wetterstrand |
| 2,188,971 | A | 2/1940 | Adonizio |
| 2,203,278 | A | 6/1940 | Foley |
| D122,837 | S | 10/1940 | Ebling |
| 2,219,123 | A | 10/1940 | Wold |
| 2,242,170 | A | 5/1941 | Birkigt |
| 2,414,967 | A | 1/1947 | Meyers |
| 2,520,548 | A | 8/1950 | Jack |
| 3,120,963 | A | 2/1964 | Seckel |
| 3,279,807 | A | 10/1966 | Jacobson |
| 3,526,976 | A | 9/1970 | Jacobs |

(Continued)

FOREIGN PATENT DOCUMENTS

| | | |
|---|---|---|
| DE | 297 23 193 U 1 | 6/1998 |

(Continued)

*Primary Examiner*—Christopher Bottorff
(74) *Attorney, Agent, or Firm*—Jones Day

(57) ABSTRACT

An ice skate comprising a blade and a blade holder. The blade holder providing decreasing, non rigid, and/or no lateral support in a rearward region of the blade so that it may facilitate increased or freer flexibility of the blade and improved maneuverability. The blade is rigidly laterally supported at a front end section of the blade holder and preferably also at a back end section of the blade holder so that it may facilitate efficient transfer of force between the skater and the blade. One or more non-rigid support members may be employed to control, absorb and/or cushion the flexing of the blade. The ice skate may be tuned to reflect the desired performance requirements of the individual skater and/or use.

58 Claims, 7 Drawing Sheets

U.S. PATENT DOCUMENTS

| | | | | |
|---|---|---|---|---|
| 3,558,149 | A | | 1/1971 | Weidenbacker |
| 3,689,091 | A | | 9/1972 | Nagin |
| 3,784,217 | A | | 1/1974 | Staples |
| 3,785,662 | A | | 1/1974 | Staples |
| 3,814,453 | A | | 6/1974 | Staples |
| 3,866,927 | A | | 2/1975 | Tvengsberg |
| 3,918,729 | A | | 11/1975 | Peters |
| 3,934,892 | A | | 1/1976 | Baikie |
| 3,947,050 | A | | 3/1976 | Isely |
| 3,954,278 | A | | 5/1976 | McLeod |
| 3,967,832 | A | | 7/1976 | Chambers |
| 3,993,318 | A | | 11/1976 | Rothmayer |
| 4,008,901 | A | | 2/1977 | Conn |
| 4,021,054 | A | | 5/1977 | Csutor |
| D245,800 | S | | 9/1977 | Gustavsson et al. |
| D245,872 | S | | 9/1977 | Baikie et al. |
| 4,053,168 | A | | 10/1977 | Goverde |
| 4,071,938 | A | | 2/1978 | Chambers |
| 4,074,909 | A | | 2/1978 | Baikie |
| 4,085,944 | A | | 4/1978 | Chambers |
| 4,088,335 | A | | 5/1978 | Norton et al. |
| 4,093,249 | A | | 6/1978 | Chambers |
| D248,583 | S | | 7/1978 | Zuuring |
| 4,107,856 | A | | 8/1978 | Bourque |
| 4,108,450 | A | | 8/1978 | Cote |
| 4,114,295 | A | | 9/1978 | Schaefer |
| D249,973 | S | | 10/1978 | Norton et al. |
| 4,126,323 | A | | 11/1978 | Scherz |
| D250,490 | S | | 12/1978 | Baikie et al. |
| 4,139,209 | A | | 2/1979 | Humphreys |
| 4,144,659 | A | | 3/1979 | Eisenberg |
| 4,150,499 | A | | 4/1979 | Wang |
| 4,150,837 | A | | 4/1979 | Zuuring |
| D253,670 | S | | 12/1979 | Gustavsson et al. |
| D254,201 | S | | 2/1980 | Norton et al. |
| 4,218,069 | A | | 8/1980 | Baikie |
| 4,223,900 | A | | 9/1980 | Olivieri |
| 4,251,086 | A | | 2/1981 | Wooley |
| 4,252,345 | A | | 2/1981 | Cabral |
| 4,264,090 | A | | 4/1981 | Davies |
| 4,268,981 | A | | 5/1981 | Olivieri |
| 4,282,659 | A | | 8/1981 | Bourque et al. |
| D262,986 | S | | 2/1982 | Cox, Jr. |
| 4,314,708 | A | | 2/1982 | Zuuring |
| 4,324,408 | A | | 4/1982 | Bensette et al. |
| 4,328,627 | A | | 5/1982 | Sanders |
| D264,984 | S | | 6/1982 | Olivieri |
| 4,336,948 | A | | 6/1982 | Couture |
| 4,351,536 | A | | 9/1982 | Sandino |
| 4,351,537 | A | | 9/1982 | Seidel |
| 4,353,173 | A | | 10/1982 | Paquet |
| 4,353,562 | A | | 10/1982 | Tiefenthal |
| 4,379,563 | A | | 4/1983 | Arsenault |
| 4,384,413 | A | | 5/1983 | Bourque |
| 4,392,658 | A | | 7/1983 | Redmond et al. |
| 4,394,042 | A | | 7/1983 | Smith |
| D271,036 | S | | 10/1983 | Baikie |
| 4,407,522 | A | | 10/1983 | Suroff |
| 4,413,430 | A | | 11/1983 | Brown |
| 4,418,928 | A | | 12/1983 | Cox |
| 4,453,727 | A | | 6/1984 | Bourque |
| D274,742 | S | | 7/1984 | Couture |
| D275,218 | S | | 8/1984 | Chang |
| 4,492,385 | A | | 1/1985 | Olson |
| 4,507,880 | A | | 4/1985 | Ohashi |
| 4,509,276 | A | * | 4/1985 | Bourque ..... 36/115 |
| 4,520,580 | A | | 6/1985 | Brown |
| 4,549,742 | A | | 10/1985 | Husak et al. |
| D285,819 | S | | 9/1986 | Bourque |
| D285,820 | S | | 9/1986 | Bourque |
| D286,903 | S | | 11/1986 | Olivieri |
| 4,655,465 | A | | 4/1987 | Schaeffer |
| 4,657,265 | A | | 4/1987 | Ruth |
| 4,666,169 | A | | 5/1987 | Hamill et al. |
| 4,699,390 | A | | 10/1987 | Cote |
| 4,744,574 | A | | 5/1988 | Soo |
| 4,773,658 | A | | 9/1988 | Bourque et al. |
| 4,777,741 | A | | 10/1988 | James |
| 4,783,911 | A | | 11/1988 | Brown |
| 4,826,183 | A | | 5/1989 | Bratland et al. |
| 4,835,885 | A | | 6/1989 | Hoshizaki et al. |
| 4,870,761 | A | | 10/1989 | Tracy |
| D305,560 | S | | 1/1990 | Hoshizaki et al. |
| 4,906,013 | A | | 3/1990 | Hussien et al. |
| 4,907,813 | A | | 3/1990 | Hall |
| 4,964,229 | A | | 10/1990 | Laberge |
| 4,988,122 | A | | 1/1991 | Saunders |
| 4,993,725 | A | | 2/1991 | Barnes et al. |
| 5,046,746 | A | | 9/1991 | Gierveld |
| 5,072,529 | A | | 12/1991 | Graf |
| D323,056 | S | | 1/1992 | Cavasin |
| 5,088,749 | A | | 2/1992 | Olivieri |
| D325,416 | S | | 4/1992 | Olson et al. |
| 5,123,664 | A | | 6/1992 | DeMars |
| 5,125,687 | A | | 6/1992 | Hwang |
| 5,129,663 | A | | 7/1992 | Soo |
| D328,771 | S | | 8/1992 | Molnar |
| 5,137,290 | A | | 8/1992 | Patterson et al. |
| 5,161,810 | A | | 11/1992 | DeCesare |
| 5,170,574 | A | | 12/1992 | Weisbrich |
| 5,184,834 | A | | 2/1993 | Yu |
| 5,193,827 | A | | 3/1993 | Olson |
| 5,234,230 | A | | 8/1993 | Crane et al. |
| 5,248,156 | A | | 9/1993 | Cann et al. |
| 5,255,929 | A | | 10/1993 | Lemelson |
| 5,259,632 | A | | 11/1993 | Mahoney |
| 5,318,310 | A | | 6/1994 | Laberge |
| 5,320,366 | A | | 6/1994 | Shing |
| 5,332,242 | A | | 7/1994 | Cann et al. |
| 5,354,077 | A | | 10/1994 | Soo |
| D354,105 | S | | 1/1995 | Meibock et al. |
| D354,539 | S | | 1/1995 | Meibock et al. |
| 5,383,674 | A | | 1/1995 | Cann et al. |
| 5,388,845 | A | | 2/1995 | Soo |
| 5,388,846 | A | | 2/1995 | Gierveld |
| 5,393,077 | A | | 2/1995 | Wanous |
| 5,411,278 | A | * | 5/1995 | Wittmann ..... 280/11.223 |
| D361,612 | S | | 8/1995 | Hill et al. |
| 5,456,495 | A | | 10/1995 | McLeod |
| 5,459,949 | A | | 10/1995 | MacPhail |
| 5,462,295 | A | | 10/1995 | Seltzer |
| 5,484,148 | A | | 1/1996 | Olivieri |
| 5,498,009 | A | | 3/1996 | Young |
| 5,503,412 | A | | 4/1996 | Hill |
| 5,505,467 | A | | 4/1996 | Hill et al. |
| 5,524,912 | A | | 6/1996 | Laub et al. |
| D372,948 | S | | 8/1996 | Marasco |
| 5,549,331 | A | | 8/1996 | Yun et al. |
| D373,399 | S | | 9/1996 | Both |
| D373,807 | S | | 9/1996 | Swande |
| 5,570,893 | A | | 11/1996 | Swande |
| 5,595,392 | A | | 1/1997 | Casillas |
| D379,395 | S | | 5/1997 | Aird |
| 5,641,169 | A | | 6/1997 | Bekessy |
| D380,516 | S | | 7/1997 | Cavasin |
| 5,662,338 | A | * | 9/1997 | Steinhauser, Jr. ..... 280/7.14 |
| 5,769,434 | A | | 6/1998 | Wurthner |
| D396,515 | S | | 7/1998 | Venier et al. |
| 5,779,246 | A | | 7/1998 | Bengtsson |
| 5,940,991 | A | | 8/1999 | Cabalquinto |
| 5,961,129 | A | * | 10/1999 | Post et al. ..... 280/7.13 |
| 5,988,683 | A | | 11/1999 | Venier et al. |
| 6,039,328 | A | | 3/2000 | Pawlowski et al. |
| 6,079,128 | A | | 6/2000 | Hoshizaki et al. |

6,105,975 A * 8/2000 Shum ..... 280/7.13
6,467,778 B1 10/2002 Goldsmith et al.
6,695,322 B2 2/2004 Goldsmith et al.

FOREIGN PATENT DOCUMENTS

EP 0 273 891 A2 7/1988
EP 0 273 891 A3 6/1991
EP 0 788 818 A2 8/1997
EP 0 788 818 A3 11/1997
GB 2316327 A 2/1998
NR 254009 5/1967
WO WO 94/08668 4/1994
WO WO 99/12615 3/1999

* cited by examiner

ICE SKATE

CROSS-REFERENCE TO RELATED APPLICATIONS

This application is a continuation of U.S. patent application Ser. No. 10/746,955 filed on Dec. 23, 2003, now abandoned, which is a continuation of U.S. application Ser. No. 10/230,799 filed on Aug. 28, 2002, now U.S. Pat. No. 6,695,322 which is a continuation of U.S. patent application Ser. No. 09/156,847 filed on Sep. 16, 1998, now U.S. Pat. No. 6,467,778. This application claims priority under 35 U.S.C. §120 to each of the foregoing-identified applications, which are hereby incorporated by reference in their entirety.

BACKGROUND OF THE INVENTION

The field of the present invention is ice skates.

The following U.S. patents are hereby incorporated by reference: U.S. Pat. Nos. 5,484,148, 5,456,495, 5,383,674, 5,332,242, 5,318,310, 5,248,156, 4,826,183, 4,773,658, 4,453,727, 4,218,069, 4,150,837, 4,088,335, 4,085,944, 4,074,909, 4,071,938, 4,053,168, and 3,934,892, and U.S. Patent Nos. Des. 254,201, and 249,973.

In conventional ice skate assemblies such as those disclosed in the aforementioned referenced patents and those manufactured and sold by Canstar Sports Group, Inc. under the trademark TUUK, a molded plastic blade holder, which is designed to be attached to or integral with a skate boot, has a longitudinal slot or groove in which an ice skate blade is snugly received. The blade holder, either separately or in combination with a reinforcement member of greater rigidity, is designed to be in direct contact with the sides of the blade and, thereby, provides lateral support along the full longitudinal length of the blade. Greater support is typically provided toward the front and rear of the blade and less support in an around the center of the blade. The center sections are generally designed to provide increasing or non-varying lateral support to an underlying portion of the blade located generally behind the ball of the foot and increasing or non-varying as it extends toward the heel.

In operation, the support provided by the blade holder functions to inhibit the blade from freely flexing in the lateral direction along its longitudinal axis and twisting around its longitudinal axis. While conventional blade holders provide a certain degree of lateral and torsional support to the blade they nonetheless are capable of being twisted, flexed, and/or bent by the forces placed on them by the blade. Such deformations while perhaps beneficial in some circumstances may be detrimental to the efficient transfer of force between the skater and the skate blade and to the maneuverability of the skater.

Accordingly, a need exists for an improved ice skate that can efficiently transfer force so as to facilitate rapid acceleration and deceleration and yet achieve the desired maneuverability.

SUMMARY OF THE INVENTION

The present invention is directed to an ice skate including a blade holder and blade. The configuration of the combination provides decreasing, non-rigid and/or no lateral support in a section of the blade holder.

Accordingly, a first separate aspect of the present inventions comprises an ice skate having a blade holder and a blade. The blade holder comprises an elongate body extending from a front end section to a back end section. The blade includes a front end and a back end, the front end being enclosed by the front end section of the blade holder and the back end being enclosed by the back end section of the blade holder. The blade is rigidly laterally supported at the front end section of the blade holder; and a portion of at least one side of the blade located behind the front end section is laterally unsupported and displaced from the blade holder.

A second separate aspect of the present invention comprises an ice skate having a blade, a blade holder, and an elastic non-rigid support member. The blade includes a first and second side, an upper surface, an ice engaging surface generally opposed to the upper surface, and a forward section. The blade holder rigidly laterally supports the blade at the forward section of the blade. A portion of the first side of the blade located behind the forward section is displaced from the blade holder. An elastic non rigid support member is interposed between the blade holder and the portion of the first side of the blade located behind the forward section of the blade that is displaced from the blade holder.

A third separate aspect of the present invention comprises an ice skate having a blade holder and a blade. The blade holder includes a front member having a front end section, a back member having a back end section, the front member extending from the front end section toward the back member and the back member extending from the back end section toward the front member. The blade includes a front end and a back end, the front end being enclosed by the front member and the back end being enclosed by the back member, the blade being rigidly laterally supported at the front end section. A portion of at least one side of the blade located behind the front end section is unsupported and displaced from the blade holder.

A fourth separate aspect of the present invention comprises an ice skate having a blade and a blade holder. The blade holder includes a front member generally underlying the toe region and the forward metatarsal area of the sole, a back member generally underlying the heel of the sole, and a center section longitudinally extending from the front member to the back member. The center section includes a portion that is more laterally rigid toward the front member than the back member. The blade is laterally supported at the front end section of the blade holder.

A fifth separate aspect of the present invention comprises an ice skate having a blade holder and a blade. The blade holder includes a front end section, a back end section and a center section longitudinally extending between the front end section and the back end section. A portion of the center section located behind the ball of the foot has continuous decreasing lateral rigidity extending toward the heel of the foot. The blade is laterally supported at the front end section of the blade holder.

In a sixth separate aspect of the present invention it is contemplated that elements of the aforementioned aspects of the present invention may be combined.

Accordingly, it is an object of the present invention to provide an ice skate that can improve maneuverability and yet can be efficient in the transfer of acceleration and deceleration forces. Other and further objects and advantages will appear hereinafter.

DETAILED DESCRIPTION OF PREFERRED EMBODIMENTS

Figure 1:
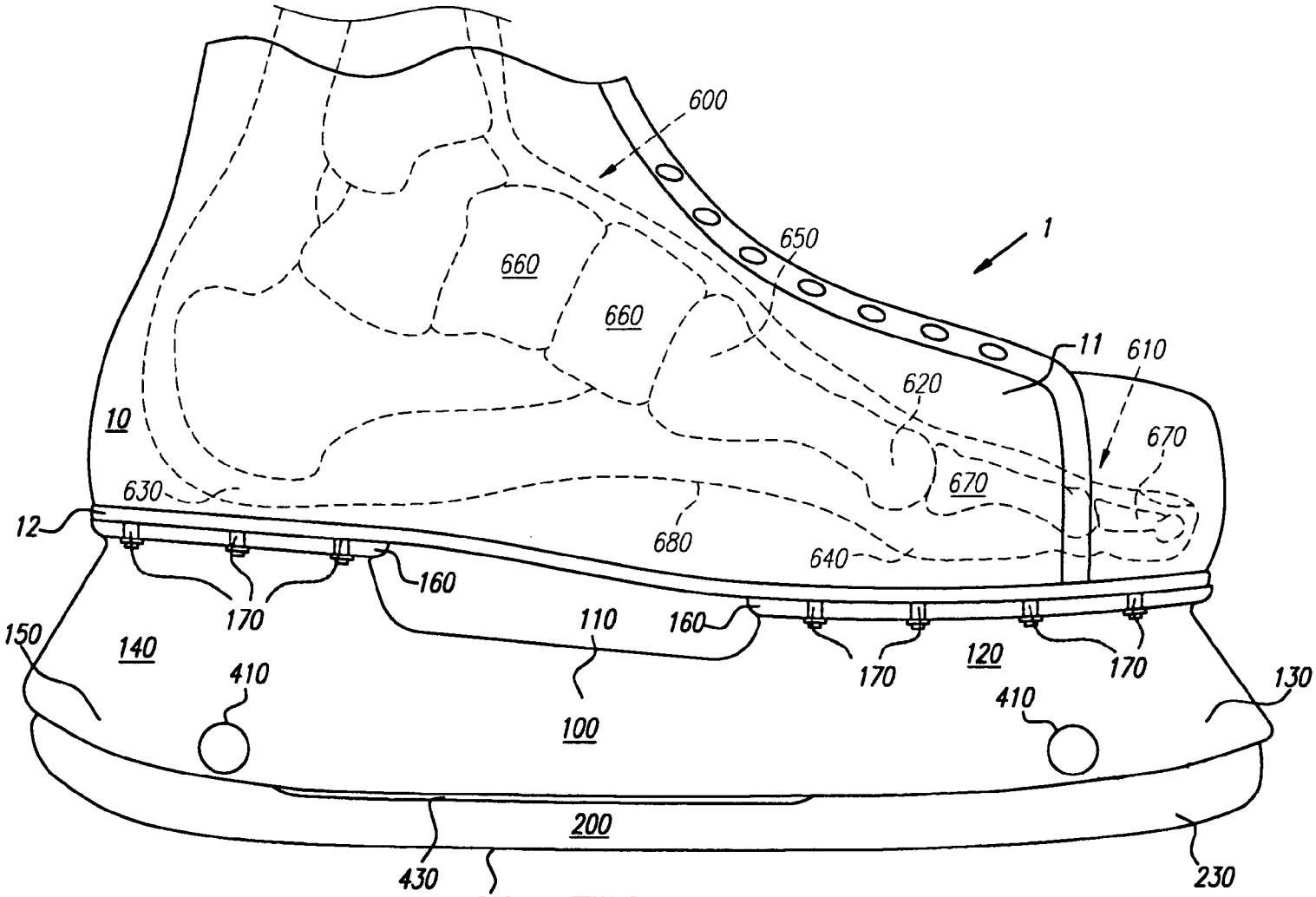
FIG. 1 is a side view of a first embodiment of an ice skate.
Figure 2:
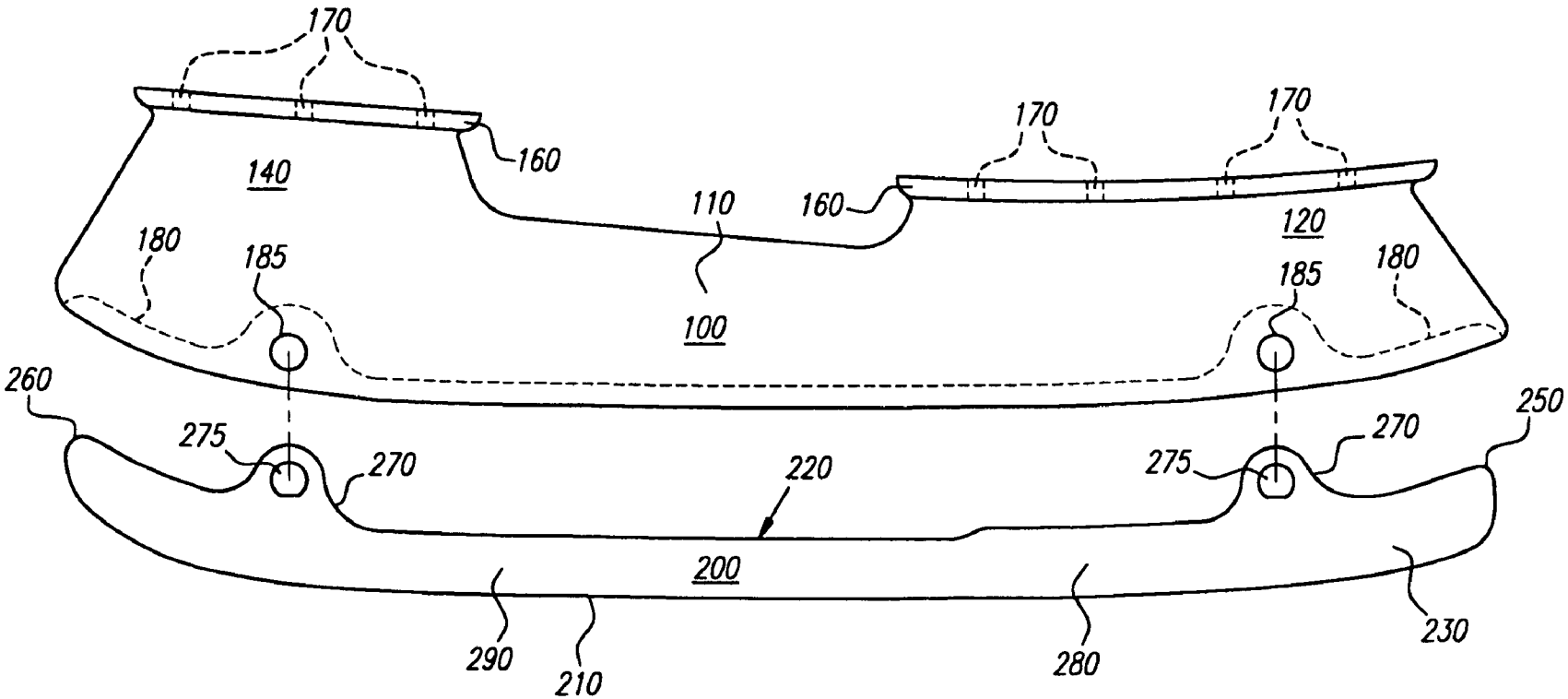
FIG. 2 is a side view of the ice skate blade holder and blade illustrated in FIG. 1, wherein the blade is unattached to the blade holder.
Figure 3:
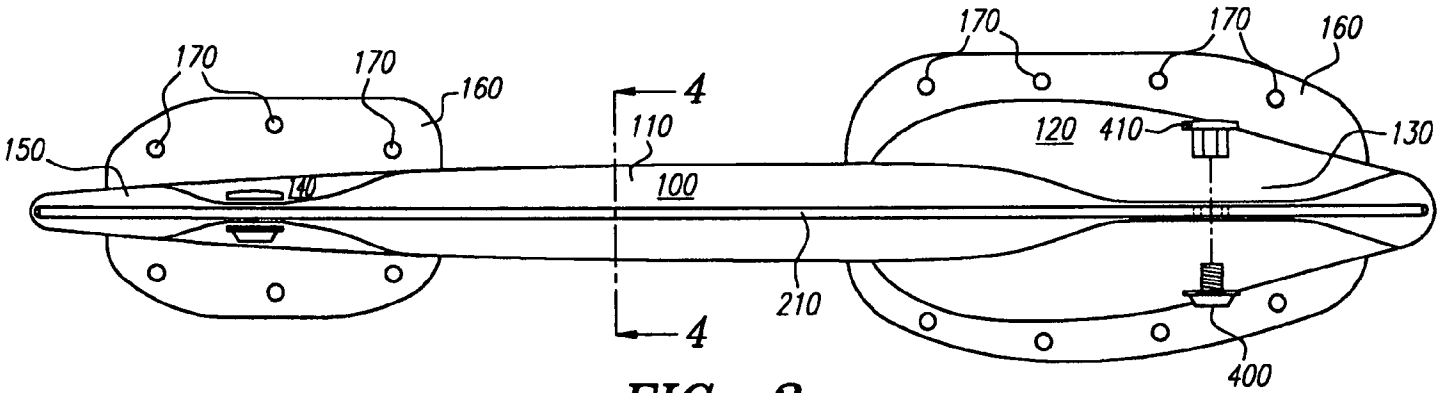
FIG. 3 is a bottom view of the ice skate blade holder and blade illustrated in FIG. 1.
Figure 4:
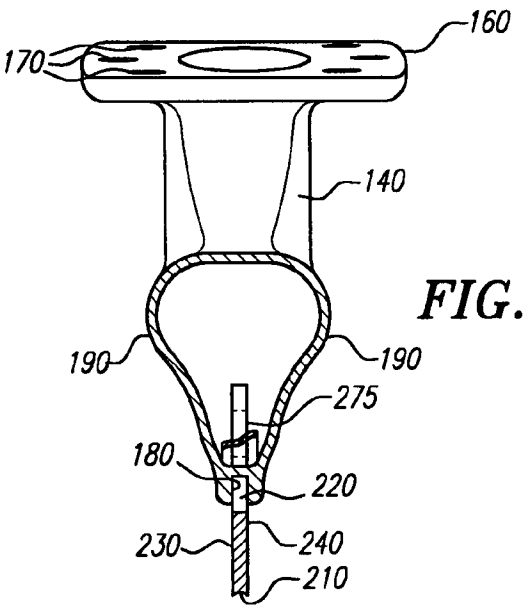
FIG. 4 is a cross-sectional view taken along line 4-4 of FIG. 3.

In the drawings, for clarity of description, any reference numeral representing an element in one figure shall represent the same element in any other figure.

FIGS. 1-4 illustrate a first preferred embodiment of the present invention. FIG. 1 illustrates an ice skate 1 comprising an ice skate boot 10, an ice skate blade holder 100 and an ice skate blade 200. The ice skate boot 10 is comprised of an upper 11, an outsole 12, the outsole 12 being attached to the ice skate blade holder 100. The blade holder 100 is comprised of a front member 120 including a front end section 130 and a back member 140 including a back end section 150. The front member 120 may be in the form of a front pedestal generally underlying the toe region 610 and the forward metatarsal area 620 of the skater's foot 600 overlying the outsole 12. The back member 140 may be in the form of a rear pedestal generally underlying the heel 630 of the skater's foot 600 overlying the outsole 12. Flanges 160 surround the top of the blade holder 100 at the front and back members 120, 140. Blade holder-boot attachment holes 170 may be provided through the flanges 160 to facilitate the attachment of the blade holder 100 to the boot 10 via conventional means such as rivets, screws or the like. It should be recognized however that the blade holder 100 could be formed integrally with the ice skate boot 10, thus, making conventional mechanical attachment of the blade holder 100 to the ice skate boot 10 unnecessary.

In order to improve the blade holder's integrity and rigidity and to facilitate efficient communication between the front and back members 120 and 140, the ice skate blade holder 100 is preferably further comprised of a center section 110 extending longitudinally between the front and back members 120 and 140. In this configuration, the blade holder 100 is generally in the form of an elongate body.

Grooves 180 adapted to snugly receive the blade 200 are formed at the bottom of the blade holder 100. Blade attachment holes 185 are provided through the blade holder 100 at the front and back members 120 and 140 to facilitate the retention of the blade 200 within the blade holder 100. The blade holder 100 may be formed of opposed wall members 190 manufactured of fiber reinforced composite material such as fiber reinforced rigid plastic, sheet and bulk molding compounds of a high fiber content, or like material capable of providing rigid lateral support to the blade 200.

A blade 200 is formed so that it is generally curved throughout its length in a longitudinal plane to define a convex lower surface or ice engaging surface 210. The blade 200 may be formed of plated or unplated carbon steel, stainless steel, or any material that functions to achieve the desired results. The ice engaging surface 210 usually includes one or more edges that engage the ice surface. Generally opposed to the ice engaging surface is an upper surface 220 of the blade 200. The blade 200 is further comprised of a first and second side 230 and 240 generally opposed to one another and generally vertical to the ice engaging surface 210 and the upper surface 220. The blade 200 further comprises a front end 250 and a back end 260. Positioning holes 275 are provided in attachment ears 270 of the blade 200 so that when the blade 200 is received in the blade holder 100 the positioning holes 275 are generally concentric with the blade attachment holes 185. Screws 400 and securing nuts 410, adapted to being secured to one another and directionally received within the positioning holes 275 and the blade attachment holes 185, retain the blade 200 within the grooves 180 of the blade holder 100.

As best illustrated in FIGS. 1, and 3-6, the blade 200 is rigidly supported in the lateral direction at a forward section 280 of the blade 200 and preferably at the front end section 130 of the blade holder 100. The blade 200 may also be rigidly supported in the lateral direction at a rearward section 290 of the blade 200, preferably at the back end section 150 of the blade holder 100. The rigid support can facilitate the efficient transfer of force between the skater and the skate blade 200 as well as limit the torsional bending of the blade. Thus, the rigid lateral support can facilitate the skater's efficient acceleration and deceleration. The rearward section 290 of the blade 200 is defined as the section of the blade 200 located rearward (toward the heel) of the forward section 280 of the blade 200. A portion of at least one side of the rearward section 290 of the blade 200 is laterally unsupported and displaced from the blade holder 100 to facilitate the flexing of the blade 200 in the lateral direction along the blade's longitudinal axis and thereby allows the blade 200 to "hug" or bend into contact with the ice surface. This portion is preferably located generally behind the ball 640 of the skater's foot 600 underneath the rearward metatarsal 650 and/or tarsal 660 bones of the skater's foot 600.

In this preferred embodiment, a portion of the upper surface 220 of the blade 200 located in the rearward section 290 is displaced from the blade holder 100 so as to form a void 430 between the blade holder 100 and the upper surface 220 of the blade 200. The void 430 is formed so that it underlies a portion of the center section 110 of the blade holder 100. The void 430 may be achieved by reducing the height of the blade 200. The height of the blade 200 is defined by the distance between the upper surface 220 and the ice engaging surface 210 of the blade 200. While the void 430 in this preferred embodiment is achieved via the design of the blade 200, it should be understood that the void 430 may also be formed by modification or design of the blade holder 100. The front end 250 and the back end 260 of the blade 200 are enclosed within the blade holder 100 at the front member 120 and back member 140 of the blade holder 100, respectively.

Figure 5:
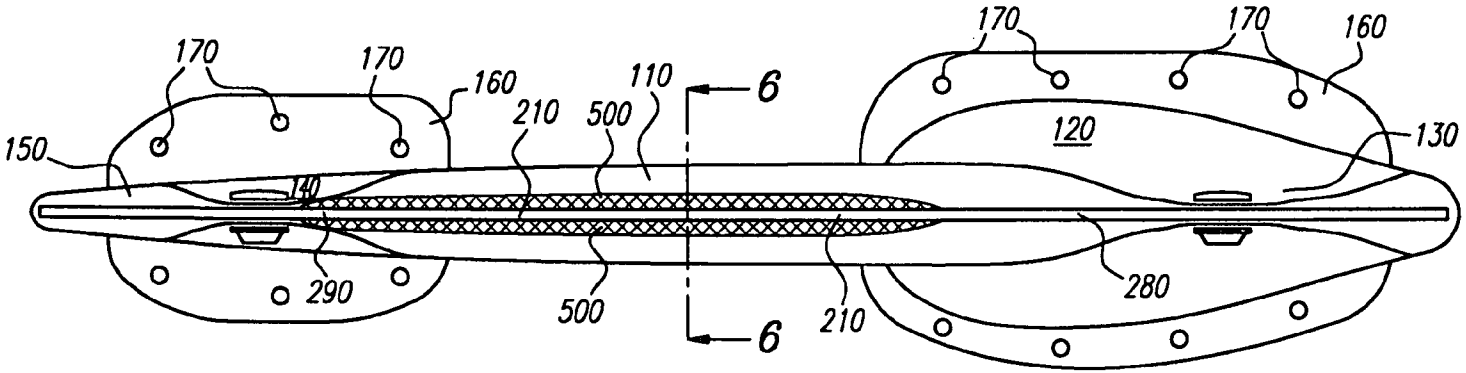
FIG. 5 is a bottom view of a second alternative embodiment of an ice skate blade holder and blade.
Figure 6:
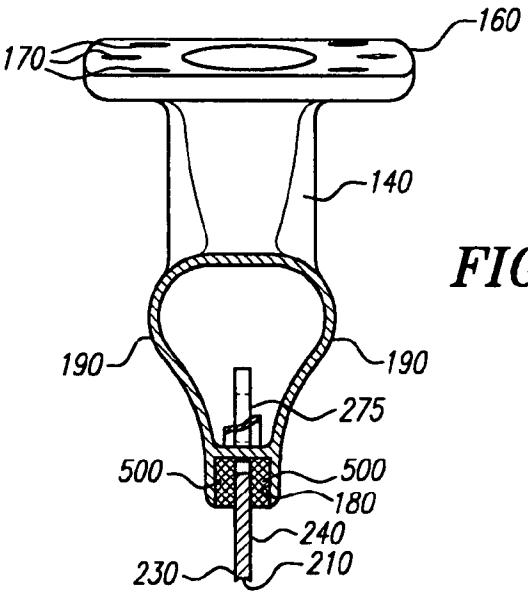
FIG. 6 is a cross-sectional view taken along line 6-6 of FIG. 5.

In a second alternative preferred embodiment, illustrated in FIGS. 5 and 6, the blade 200 is rigidly supported in the lateral direction at a forward section 280 of the blade 200 and preferably at the front end section 130 of the blade holder 100. The blade 200 may also be rigidly supported in the lateral direction at a rearward section 290 of the blade 200, preferably at the back end section 150 of the blade holder 100. A groove 180 is employed to house at least a portion of the rearward section 290 of the blade 200 so that the upper surface 220 resides within the groove 180. The sides of the groove 180 are set apart a distance greater than the thickness of the blade 200 so that at least a portion of one side of the rearward section 290 housed by the groove 180 is displaced from the blade holder 100, preferably in the center section 110 and more preferably behind the ball 640 of the foot 600 of the skater so as to be positioned behind the rearward metatarsal 650 and/or tarsal 660 bones of the skater. The thickness of the blade 200 is defined as the distance between the first and second side 230 and 240 of the blade 200. In this respect, the sides of the groove 180 serve the dual purpose of functioning as a rigid "stop", so as to limit the distance the blade 200 can flex in the lateral direction and as a protective guard by covering the upper edges of the blade 200.

In order to avoid frictional contact between the upper surface 220 of the blade 200 and the blade holder 100 so as to facilitate freer lateral flexibility of the blade 200, it is preferred that the upper surface 220 of the portion of the blade 200 located in the rearward section 290 and displaced from the groove 180 also be displaced from the groove's upper surface. However, it is apparent that contact between the groove's upper surface and the upper surface 220 of the blade 200 may also be practiced to achieve the substantial benefits of the invention.

In order to control, absorb or cushion the flexing of the blade 200, one or more elastic non-rigid support members 500 may be interposed between the sides of the groove 180 and a displaced portion of the first side 230 and/or the second side 240 of the rearward section 290 of the blade 200. The term "elastic" shall mean a material having greater capability to recover its size after being deformed than that material used in the construction of the portion of the blade holder 100 which the elastic non-rigid support member 500 is interposed. Materials suitable for use in manufacturing the elastic non-rigid support member 500 include elastomer thermoplastics such as urethane and rubber and thermoset materials, cork, foam elastomer, low density polyethelyne, and any other material that functions in a like manner.

The ice skate may be tuned or adjusted to reflect the abilities of the user and or the type of use for which the ice skate is employed. For example, for heavier or more accomplished skaters the length of the displaced and/or unsupported portion of the rearward section 290 of the blade 200 may be shortened to reflect the skater's capabilities of exerting the force required for flexing the blade 200 in the lateral direction.

The ice skate could also be tuned via the selection of the material(s) used in the construction of the elastic non-rigid support member(s) 500. The choice of material(s) would be based, among other things, on their suitability in effectuating the desired performance for the particular individual skater and/or use, as well as, the inherent lateral rigidity of the blade holder 100 and blade 200 as reflected in their design and the materials employed in their manufacture. Furthermore, the selection of the materials employed in the manufacture of the elastic non-rigid support members 500 may reflect the distinctive characteristic forces of supination and pronation of the skater's foot. For example, the material(s) employed in the manufacture of the elastic non-rigid support member 500 on the medial side of the blade 200 may be different than the material employed on the lateral side of the blade 200. In addition, the size and placement of the elastic non-rigid member 500 in the rearward section 290 of the blade 200 may differ to reflect the desired performance.

Figure 7:
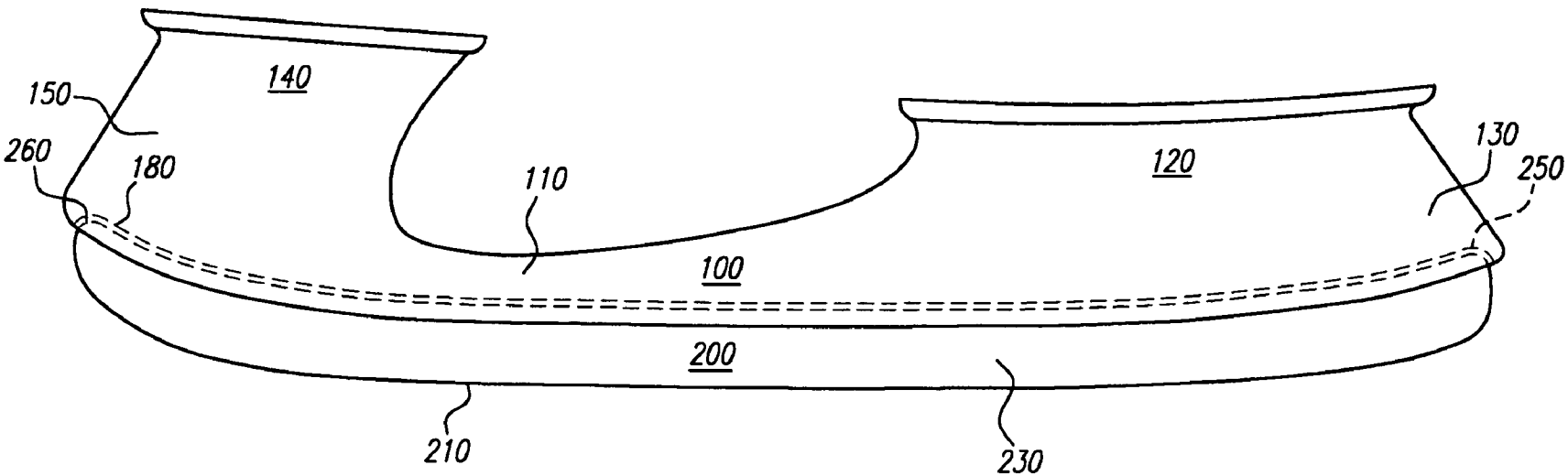
FIG. 7 is a side view of a third alternative embodiment.
Figure 8:
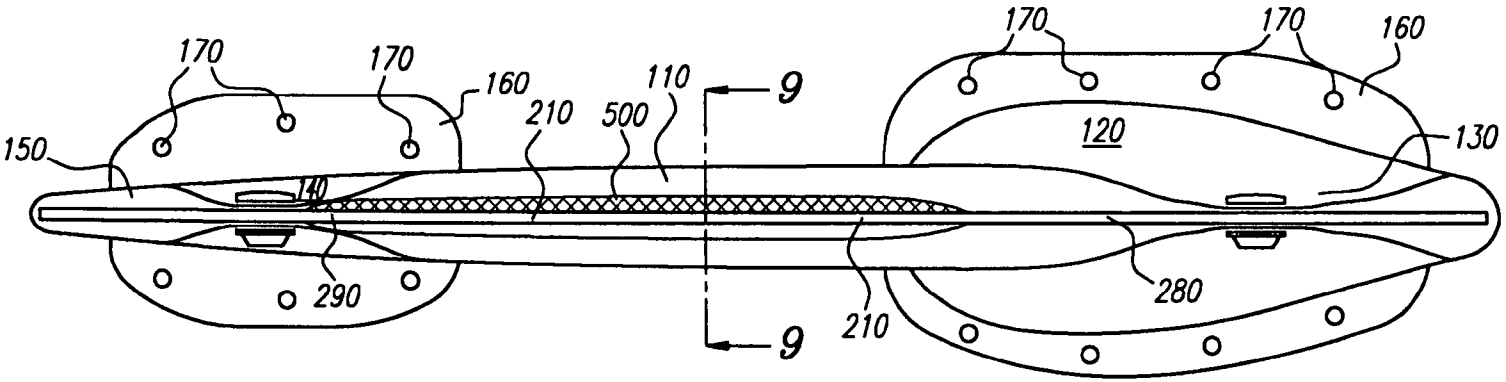
FIG. 8 is a bottom view of a second preferred implementation of the second alternative embodiment of an ice skate blade holder and blade depicted in FIG. 5.
Figure 9:
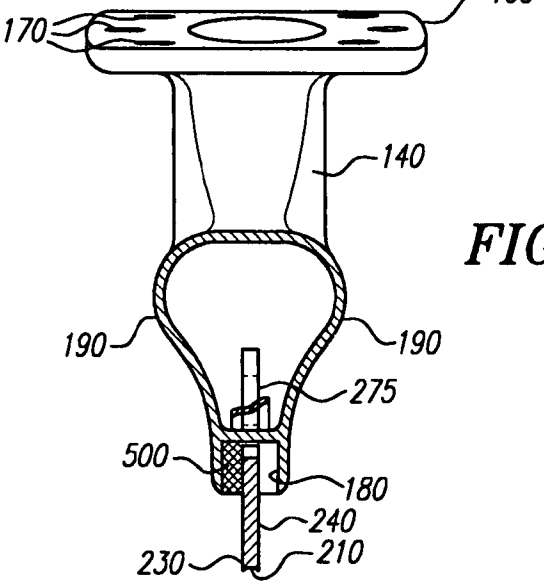
FIG. 9 is a cross-sectional view taken along line 9-9 of FIG. 8.
Figure 10:
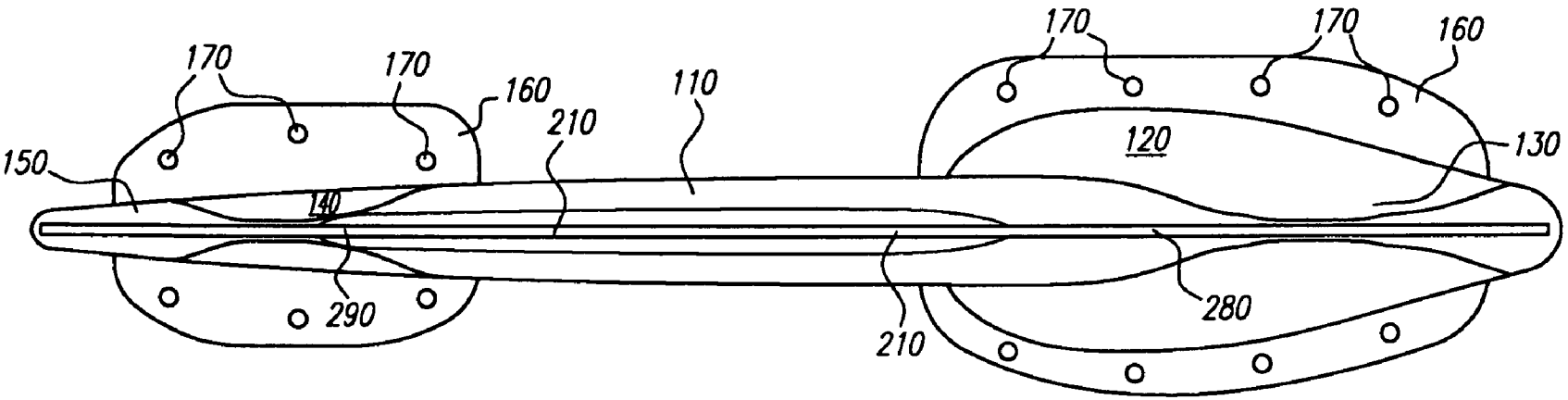
FIG. 10 is a bottom view of a first preferred implementation of the third alternative embodiment depicted in FIG. 7.

In a third alternative preferred embodiment illustrated in FIG. 7, a section of the blade holder 100 is designed so that there is a portion of continuous decreasing lateral support located rearward from the ball 640 of the ice skater's foot 600. The ball 640 of the foot 600 is defined generally as the area where the most medial forward metatarsal 620 bone meets the most medial phalange 670 bone of the foot 600 and is characterized externally by the beginning of the arch 680 of the foot 600 on the medial side of the foot 600. The decreasing lateral support located rearward from the ball 640 of the ice skater's foot 600 and extending toward the heel of the foot 600 can facilitate an increasing and transitionally smooth flexing of the underlying region of the blade 200 and can facilitate improved skater maneuverability. It is preferable that the section of the blade holder having decreasing lateral support be positioned to underlie the rearward metatarsal 650 and/or the tarsal 660 bones of the skater. In this preferred embodiment, the center section 110 of the blade holder 100 longitudinally extending from the front member 120 to the back member 140 is formed with decreasing lateral rigidity from behind the ball 640 of the foot 600 to the back member 140 so as to communicate decreasing lateral support to the underlying portion of the blade 200. This configuration is achieved by a continuous decrease in the height of the blade holder 100 in a section located rearward from the ball 640 of the foot 600 and extending toward the back member 140. The height of the blade holder 100 is defined as the distance, in a given vertical plane, between the lower edge of the blade holder 100 and the top surface of the blade holder 100. Alternative blade holder designs such as varying the thickness of the wall members 190, varying the distance between the wall members 190, and/or by selecting the resilience of the material(s) employed in the manufacture of the blade holder 100 may also achieve the desired results.

The foregoing specification and the drawings forming part hereof are illustrative in nature and demonstrate certain preferred embodiments of the invention. It should be recognized and understood, however, that the description is not to be construed as limiting of the invention because many changes, modifications and variations may be made therein by those of skill in the art without departing from the essential scope, spirit or intention of the invention. Accordingly, it is intended that the scope of the invention be limited solely by the appended claims

What is claimed is:

1. An ice skate for a foot comprising:

a boot;

a blade holder including a unitary elongate body extending in length from a front end section to a back end section; and a blade extending from a front end to a back end and having opposing sides, the front end being enclosed by the front end section, the back end being enclosed by the back end section, the blade being rigidly laterally supported along the entire length of the front end section and alone the entire length of the back end section of the blade holder and a portion of the blade, extending from the rigid lateral support at the front end section to the rigid lateral support at the back end section, not being rigidly laterally supported on at least one of its sides.

2. The ice skate as set forth in claim 1, the blade holder further including a tubular mid-section disposed between said front and back end sections and vertically spaced apart from said boot and displaced from said blade.

3. The ice skate as set forth in claim 1, wherein the blade holder further comprises a groove adapted to snugly receive the blade.

4. The ice skate as set forth in claim 1, wherein a portion of both sides of the blade extending from the rigid lateral support at the front end section to the rigid lateral support at the back end section being laterally unsupported and displaced from the blade holder.

5. The ice skate as set forth in claim 1, wherein the blade further comprises an upper surface, the upper surface being spaced apart from the blade holder so as to form a void between the upper surface and the blade holder.

6. The ice skate as set forth in claim 1, wherein a portion of the blade that is not rigidly laterally supported is located behind the ball of the foot.

7. The ice skate as set forth in claim 1, further comprising an elastic non-rigid support member being interposed between a portion of the blade and the blade holder.

8. The ice skate as set forth in claim 7, wherein the blade holder further comprises a groove and the elastic non-rigid support member is interposed between a portion of at least one side of the blade and the groove.

9. The ice skate set forth in claim 1, wherein the blade is removably coupled to the blade holder.

10. The ice skate set forth in claim 1, wherein said portion of the blade, extending from the rigid lateral support at the front end section to the rigid lateral support at the back end section that is not being rigidly laterally supported on at least one of its sides, is configured to extend from the ball of the foot to the heel of the foot.

11. The ice skate set forth in claim 1, wherein said portion of the blade, extending from the rigid lateral support at the front end section to the rigid lateral support at the back end section that is not being rigidly laterally supported on at least one of its sides, is configured to extend the full length of the arch of the foot.

12. The ice skate set forth in claim 1, wherein said portion of the blade, extending from the rigid lateral support at the front end section to the rigid lateral support at the back end section that is not being rigidly laterally supported on at least one of its sides, is laterally unsupported on at least one of its sides.

13. The ice skate set forth in claim 1, wherein said portion of the blade, extending from the rigid lateral support at the front end section to the rigid lateral support at the back end section that is not being rigidly laterally supported on at least one of its sides, is displaced from the blade holder.

14. The ice skate set forth in claim 1, wherein said portion of the blade, extending from the rigid lateral support at the front end section to the rigid lateral support at the back end section that is not being rigidly laterally supported on at least one of its sides, is laterally unsupported and vertically displaced from the blade holder.

15. An ice skate for a foot comprising:

a boot configured to receive a foot of a skater, and having a heel region to receive the heel of the foot, a forefoot region to receive the toes and ball of the foot, an arch region extending between the heel region to the forefoot region to receive the arch of the foot;

a blade holder including a unitary elongate body extending from a front end section to a back end section and having a mid-section extending between said front and back end sections;

a blade extending from a front end to a back end and having forward, rearward and mid longitudinally extending regions, the front end being enclosed by the front end section, the back end being enclosed by the back end section, wherein:

i) the forward region of the blade extends from the enclosed front end to the mid-region of the blade and is laterally supported, ii) the rearward region of the blade extends from the enclosed back end to the mid-region of the blade and is laterally supported, and iii) the mid-region extends between the laterally supported forward and rearward regions and is laterally unsupported on one or both sides.

16. The ice skate as set forth in claim 15, wherein the blade is rigidly laterally supported at the back region.

17. The ice skate as set forth in claim 15, wherein the blade holder further comprises a groove adapted to snugly receive the blade.

18. The ice skate as set forth in claim 15, wherein the mid-region is laterally unsupported on a portion of both sides of the blade.

19. The ice skate as set forth in claim 15, wherein the mid-region is located behind the boot region configured to receive the ball of the foot.

20. The ice skate as set forth in claim 15, wherein the mid-region extends from the boot region configured to receive the ball of the foot to the boot region configured to receive the heel region of the foot.

21. The ice skate as set forth in claim 15, wherein the blade holder further comprises an elastic non-rigid support member interposed between a portion of the blade and the blade holder.

22. The ice skate set forth in claim 15, wherein the blade is removably coupled to the blade holder.

23. An ice skate for a foot comprising:

a boot configured to receive a foot of a skater, and having a heel region to receive the heel of the foot, a forefoot region to receive the toes and ball of the foot, an arch region extending between the heel region to the forefoot region to receive the arch of the foot;

a blade holder extending from a front end section to a back end section; and a blade extending from a front end to a back end, the front end being enclosed by the front end section, the back end being enclosed by the back end section, wherein said blade having a mid-point equal distance from the front end and the back end, a first point located longitudinally between the mid-point and the forefoot region of the boot, a second point located longitudinally underneath the heel region of the boot, the blade being laterally supported at the front end section of the blade holder and at least one side of the blade, extending from the first point to the second point, being not rigidly laterally supported.

24. The ice skate as set forth in claim 23, wherein the blade is rigidly laterally supported at the front end section of the blade holder.

25. The ice skate as set forth in claim 23, wherein the blade is rigidly laterally supported at the back end section of the blade holder.

26. The ice skate as set forth in claim 23, wherein a portion of both sides of the blade extending from the first point to the second point are not rigidly laterally supported.

27. The ice skate as set forth in claim 23, wherein said at least one side of the blade extending from the first point to the second point that is not rigidly laterally supported extends to the region of the boot configured to receive the ball of the foot.

28. The ice skate as set forth in claim 23, further comprising an elastic non-rigid support member being interposed between a portion of the blade and the blade holder.

29. The ice skate as set forth in claim 28, wherein the blade holder further comprises a groove and the elastic non-rigid support member is interposed between a portion of at least one side of the blade and the groove.

30. The ice skate set forth in claim 23, wherein the blade is removably coupled to the blade holder.

31. The ice skate set forth in claim 23, wherein said at least one side of the blade extending from the first point to the second point is laterally unsupported.

32. The ice skate set forth in claim 23, wherein said at least one side of the blade extending from the first point to the second point is displaced from the blade holder.

33. The ice skate set forth in claim 23, wherein said at least one side of the blade extending from the first point to the second point is laterally unsupported and vertically displaced from the blade holder.

34. An ice skate for a foot comprising:

a boot configured to receive a foot of a skater, and having a heel region to receive the heel of the foot, a forefoot region to receive the toes and ball of the foot, an arch region extending between the heel region to the forefoot region to receive the arch of the foot;

a blade holder extending from a front end section to a back end section;

a blade extending from a front end to a back end and having generally opposing side walls, the front end being enclosed by the front end section, the back end being enclosed by the back end section;

the blade having a forward and a rearward longitudinally extending regions that meet at a mid-point equal distance from the front end and the back end, wherein:

i) the forward region extends rearward from the front end and transitions in a single location from being laterally supported on both side walls at the front end to laterally unsupported on at least one side wall as it extends to the mid-point, ii) the rearward region extends forward from the back end and transitions in a single location from being laterally supported on both side walls at the back end to laterally unsupported on at least one side wall as it extends to the mid-point, and iii) the mid-point being laterally unsupported on at least one side wall.

35. The ice skate as set forth in claim 34, wherein the blade holder further comprises a groove adapted to snugly receive the blade.

36. The ice skate as set forth in claim 34, wherein the mid-point is laterally unsupported on both side walls.

37. The ice skate as set forth in claim 34, wherein the region of the blade extending between the transitions is vertically displaced from the blade holder.

38. The ice skate as set forth in claim 34, further comprising an elastic non-rigid support member being interposed between a portion of the blade and the blade holder.

39. The ice skate as set forth in claim 38, wherein the blade holder further comprises a groove and the elastic non-rigid support member is interposed between a portion of at least one side of the blade and the groove.

40. The ice skate set forth in claim 34, wherein the blade is removably coupled to the blade holder.

41. The ice skate as set forth in claim 34, wherein the region of the blade extending between the transitions is configured to extend longitudinally from the toe region of the boot to the heel region of the boot.

42. The ice skate as set forth in claim 34, wherein the region of the blade extending between the transitions is configured to extend longitudinally to the region of the boot configured to receive the ball of the foot.

43. An ice skate for a foot comprising a boot configured to receive a foot of a skater, and having a heel region to receive the heel of the foot, a forefoot region to receive the toes and ball of the foot, an arch region extending between the heel region to the forefoot region to receive the arch of the foot;

a blade holder extending from a front end section to a back end section; and a blade extending longitudinally from a front end to a back end, the front end being enclosed by the front end section the back end being enclosed by the back end section, wherein:

i) said blade being laterally supported at a forward region extending longitudinally from the toe region to the front end of the blade and laterally supported at a rearward region extending longitudinally from the heel region to the back end of the blade, and ii) a mid-region of the blade, extending between the laterally supported forward region and the laterally supported rearward region, being laterally unsupported.

44. The ice skate as set forth in claim 43, wherein the laterally unsupported mid-region of the blade extends longitudinally from the forefoot region of the boot to the heel region of the boot.

45. The ice skate as set forth in claim 43, wherein the laterally unsupported mid-region of the blade extends longitudinally to the region of the boot configured to receive the ball of the foot.

46. An ice skate for a foot comprising a boot configured to receive a foot of a skater, and having a heel region to receive the heel of the foot, a forefoot region to receive the toes and ball of the foot, an arch region extending between the heel region to the forefoot region to receive the arch of the foot;

a blade holder extending from a front end section to a back end section; and a blade extending longitudinally from a front end to a back end, the front end being enclosed by the front end section the back end being enclosed by the back end section, wherein:

i) said blade being laterally supported at a forward region extending longitudinally from the toe region to the front end of the blade and laterally supported at a rearward region extending longitudinally from the heel region to the back end of the blade, and ii) a mid-region of the blade, extending between the laterally supported forward region and the laterally supported rearward region, being not rigidly laterally supported on at least one side.

47. The ice skate as set forth in claim 46, wherein the mid-region of the blade extends longitudinally from the region of the boot configured to receive the forefoot region to the region of the boot configured to receive the heel region.

48. The ice skate as set forth in claim 46, wherein mid-region of the blade extends longitudinally to the region of the boot configured to receive the ball of the foot.

49. The ice skate as set forth in claim 46, wherein said mid-region is laterally un-supported on at least one side.

50. An ice skate for a foot comprising a boot;

a blade holder extending from a front end section to a back end section; and a blade extending longitudinally from a front end to a back end and having opposing side walls, the front end being enclosed by the front end section the back end being enclosed by the back end section, the blade being laterally supported along the entire longitudinal length of its side walls excluding a mid-region of the blade that is laterally unsupported on at least one of its side walls.

51. An ice skate for a foot comprising a boot;

a blade holder extending from a front end section to a back end section; and a blade extending longitudinally from a front end to a back end and having opposing side walls, the front end being enclosed by the front end section the back end being enclosed by the back end section, the blade being rigidly laterally supported on at least one side along the entire longitudinal length excluding a mid-region of the blade that is not rigidly laterally supported on at least one of its side walls.

52. An ice skate as set forth in claim 51, wherein the mid-region of the blade is not rigidly laterally supported on both of its side walls.

53. An ice skate as set forth in claim 51, wherein the mid-region of the blade is laterally unsupported on at least one of its side walls.

54. An ice skate as set forth in claim 51, wherein the mid-region of the blade is laterally unsupported on both of its side walls.

55. An ice skate as set forth in claim 51, wherein the boot includes a heel region configured to receive the heel of the foot and a forefoot region configured to receive the toes and ball of the foot, and wherein the mid-region extends from the region of the boot configured to receive the ball of the foot to the region of the boot configured to receive the heel of the foot.

56. An ice skate for a foot comprising a boot configured to receive a foot of a skater, and having a heel region to receive the heel of the foot, a forefoot region to receive the toes and ball of the foot, an arch region extending between the heel region to the forefoot region to receive the arch of the foot;

a blade holder extending from a front end section to a back end section; and a blade extending longitudinally from a front end to a back end and having opposing side walls, the front end being enclosed by the front end section the back end being enclosed by the back end section, a mid-region of the blade, which extends from the region of the boot configured to receive the ball of the foot to the region of the boot configured to receive the heel of the foot, being not rigidly laterally supported on at least one of its side walls.

57. An ice skate as set forth in claim 56, wherein the mid-region of the blade is not rigidly laterally supported on both of its side walls.

58. An ice skate as set forth in claim 56, wherein the mid-region of the blade is laterally unsupported on at least one of its side walls.

* * * * *